US006257030B1

(12) United States Patent
Davis, III et al.

(10) Patent No.: US 6,257,030 B1
(45) Date of Patent: Jul. 10, 2001

(54) THUMB-OPERATED MULTILATCH DOOR LOCK

(75) Inventors: Eugene R. Davis, III, Angola; Mark E. Riechmann, Ft. Wayne, both of IN (US)

(73) Assignee: Therma-Tru Corporation, Maumee, OH (US)

( * ) Notice: Subject to any disclaimer, the term of this patent is extended or adjusted under 35 U.S.C. 154(b) by 0 days.

(21) Appl. No.: 09/329,127

(22) Filed: Jun. 9, 1999

(51) Int. Cl.[7] ..... E05B 59/00; E05B 63/14; E05C 9/12

(52) U.S. Cl. ..... 70/107; 70/109; 70/143; 292/39

(58) Field of Search ..... 70/108, 109, 107, 70/110, 111, 143, 190, 191; 292/39, 142, 160, 335, 336

(56) References Cited

U.S. PATENT DOCUMENTS

| | | | | |
|---|---|---|---|---|
| 460,191 | * | 9/1891 | Adams et al. | 292/39 |
| 1,203,965 | * | 11/1916 | Bogenberger | 292/39 X |
| 1,277,174 | * | 8/1918 | Bakst | 70/108 |
| 1,346,143 | * | 7/1920 | Teich | 70/108 |
| 1,596,992 | * | 8/1926 | Ognowicz | 70/109 |
| 1,646,674 | * | 10/1927 | Angelillo | 70/109 |
| 2,406,459 | * | 8/1946 | Gibson | 292/39 |
| 2,584,088 | * | 1/1952 | Floyd | 292/39 X |
| 2,594,253 | * | 4/1952 | Vander Veer | 292/39 X |
| 2,743,126 | * | 4/1956 | Carsley et al. | 292/39 |
| 2,932,536 | * | 4/1960 | Pyknen | 292/39 X |
| 3,933,016 | * | 1/1976 | Nolin | 70/388 X |
| 4,156,541 | | 5/1979 | Babb, Jr. et al. | 292/21 |
| 4,962,653 | | 10/1990 | Kaup | 70/107 |
| 5,077,992 | | 1/1992 | Su | 70/107 |
| 5,265,920 | | 11/1993 | Kaup et al. | 292/40 |
| 5,290,077 | | 3/1994 | Fleming | 292/35 |
| 5,373,716 | | 12/1994 | MacNeil et al. | 70/109 |
| 5,495,731 | | 3/1996 | Riznik | 70/108 |
| 5,498,038 | | 3/1996 | Simon et al. | 292/36 |
| 5,782,114 | * | 7/1998 | Zeus et al. | 70/109 |
| 5,878,606 | * | 3/1999 | Chaput et al. | 70/108 |

FOREIGN PATENT DOCUMENTS

| | | | | |
|---|---|---|---|---|
| 174031 | * | 3/1935 | (CH) | 70/108 |
| 73602 | * | 9/1944 | (CZ) | 70/109 |
| 0021820 | * | 1/1981 | (EP) | 292/39 |
| 2540170 | * | 8/1984 | (FR) | 70/109 |
| 2122244 | * | 1/1984 | (GB) | 70/109 |
| 2225052 | * | 5/1990 | (GB) | 70/109 |

* cited by examiner

*Primary Examiner*—Lloyd A. Gall
(74) *Attorney, Agent, or Firm*—Brooks & Kushman P.C.

(57) ABSTRACT

A multipoint lock assembly for securing a door that is hinged along one edge and that has a free, swingable edge opposite the hinged edge. The assembly includes a central latch and at least one remote latch vertically spaced therefrom along the free edge of the door. The retraction of all the latches is controlled by a central latch driving mechanism in response to a manual operation either of an exterior thumb-operated latch lever or of an interior doorknob. A deadbolt is also located proximate the central latch. The deadbolt is controlled either by an externally accessed cylinder lock in response to a manual insertion and rotation of a key or by a manual rotation of an interior-mounted thumb-turn. While the deadbolt is extended, the thumb-operated latch lever and the doorknob are inoperable. At least one of the latches includes a latch trigger. This is tripped when the door is closed, allowing the latch of which it is a part to assume a superextended position. When in this position the latch cannot be forced into its retracted position unless the thumb-operated latch lever or the doorknob has been operated.

14 Claims, 3 Drawing Sheets

THUMB-OPERATED MULTILATCH DOOR LOCK

TECHNICAL FIELD

This invention relates to door lock assemblies having a plurality of latches disposed at separate locations and that is retractable from a single location by a thumb lever.

BACKGROUND ART

Door lock assemblies for use on doors having a hinged edge and an opposite, swingable free edges have been known for some time. The need for security and improved sealing qualities led to the development of door lock sets having more than one independently operated latches, and these have also become well known. While the independently operated latches represent an improvement, they also exhibit some disadvantages. For example, persons in a hurry may not notice all the latches. Even if they do, they might not want to take the extra time required to set them all. Worn or damaged latches might suffer the same fate when persons feel they do not have time to make them work or to repair them. Whatever the reasons, the security and/or integrity sought will be, to some extent, compromised.

Addressing these problems are door lock assemblies having more than one latch, each latch being retractable by manually operating a centrally located mechanism. These lock assemblies have become relatively common as well, but common problems attend them in that they can be difficult to assemble and install in a cost-effective manner. A remaining problem is the fact that, while many persons want door lock assemblies that match period or otherwise unique building or room designs, assemblies having thumb-operated multilatch door locks are reportedly not available for this application.

While the prior techniques function with a certain degree of efficiency, none discloses the advantage of the improved thumb-operated multilatch door lock of the present invention as is hereinafter more fully described.

DISCLOSURE OF INVENTION

An object of the present invention is to provide a multilatch door lock for securing a door at a plurality of locations with latches that are all retractable from one location by a thumb-operated latch lever.

Another object is to provide a thumb-operated multilatch door lock that is easy to assemble and install.

An advantage of the present invention is that its assembly and installation are cost effective.

A feature of the present invention is that it uses a popular and distinctive hardware element not previously associated with multilatch door locks.

In realizing the aforementioned and other objects, advantages and features, the multilatch door lock includes a central latch that is slidable between retracted and extended positions. At least one remote latch is spaced apart from the central latch and is also slidable between retracted and extended positions. A thumboperated operated latch lever is operably connected to the central latch and to the at least one remote latch to force each respective latch into its retracted position in response to a downward movement of the thumb-operated latch lever.

A central latch driving mechanism is operably connected to the thumb-operated latch lever and to the central latch to force the central latch into its retracted position in response to a downward movement of the thumb-operated latch lever. A remote latch driving mechanism is operably connected to the at least one remote latch. An action bar operably connects the central latch driving mechanism to the at least one remote latch driving mechanism to communicate movement of the thumb-operated latch lever to the at least one remote latch driving mechanism. Each of the central and remote latches is resiliently biased toward its extended position.

The at least one remote latch includes an upper and a lower remote latch. The at least one remote latch driving mechanism includes an upper remote latch driving mechanism and a lower remote latch driving mechanism. At least one of the latches includes a trigger mechanism to provide an additional latch extension when the latch trigger engages a strike.

The objects and advantages of the present invention are readily apparent from the following detailed description of the best mode for carrying out the invention when taken in connection with the accompanying drawings.

BRIEF DESCRIPTION OF DRAWINGS

A more complete appreciation of the invention and many of the attendant advantages thereof may be readily obtained by reference to the following detailed description when considered with the accompanying drawings in which like reference characters indicate corresponding parts in all the views, wherein.

BEST MODE FOR CARRYING OUT THE INVENTION

Figure 1:
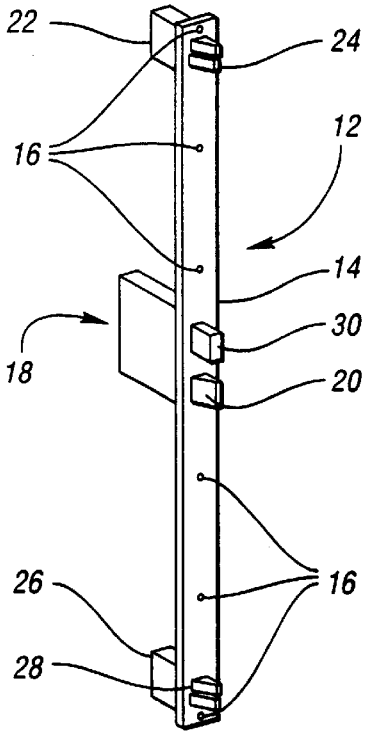
FIG. 1 is a perspective view indicating a representative configuration of a central latch, a central latch driving mechanism, two remote latches and two remote latch driving mechanisms of a door lock assembly of the present invention.
Figure 4:
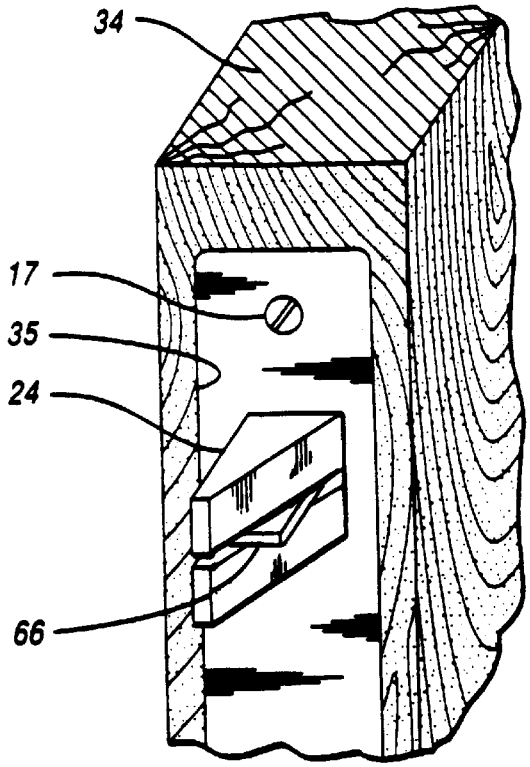
FIG. 4 is a perspective view of a remote latch of FIG. 1 shown mounted in a fragment of a door, the remote latch having a latch trigger and being shown in an extended position.
Figure 5:
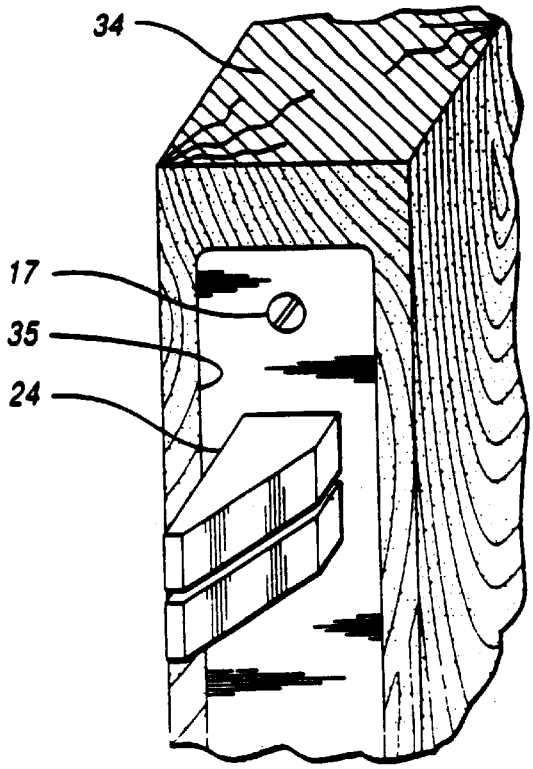
FIG. 5 is a perspective view of a remote latch of FIG. 1 shown mounted in a fragment of the door, the remote latch having a latch trigger and being shown in a superextended position.

FIG. 1 of the drawing is a perspective representation of a first subassembly, generally indicated by the reference numeral 12, of a preferred embodiment of the present invention. An elongate mounting plate 14 is provided with a plurality of mounting holes 16 to facilitate securing the mounting plate 14 to a free edge of a door (FIGS. 4 and 5) with any of a number of well-known fastening devices such as screws 17 (FIGS. 4 and 5). Secured to the mounting plate 14 is a central latch driving mechanism, generally indicated by the reference numeral 18. A central latch 20 extends from the central latch driving mechanism 18 and through the mounting plate 14.

Also secured to the mounting plate 14 is an upper remote latch driving mechanism 22 having an upper remote latch 24 extending therefrom and through the mounting plate 14. Similarly secured to the mounting plate 14 is a lower remote latch driving mechanism 26 having a lower remote latch 28 extending therefrom and through the mounting plate 14.

A deadbolt 30 also extends from the central latch driving mechanism 18 and through the mounting plate 14. The central latch driving mechanism 18 and the upper and lower remote latch driving mechanisms 22 and 26 are, as is well known, mountable within a mortise provided in a free edge of a door 34 (FIGS. 4 through 9). The mounting plate 14 is typically mountable within a shallow mounting plate channel 35 (FIGS. 4 and 5) in the free edge of the door by using screws 17 (FIGS. 4 and 5) or the like inserted through holes 16 provided in the mounting plate 14.

Figure 2:
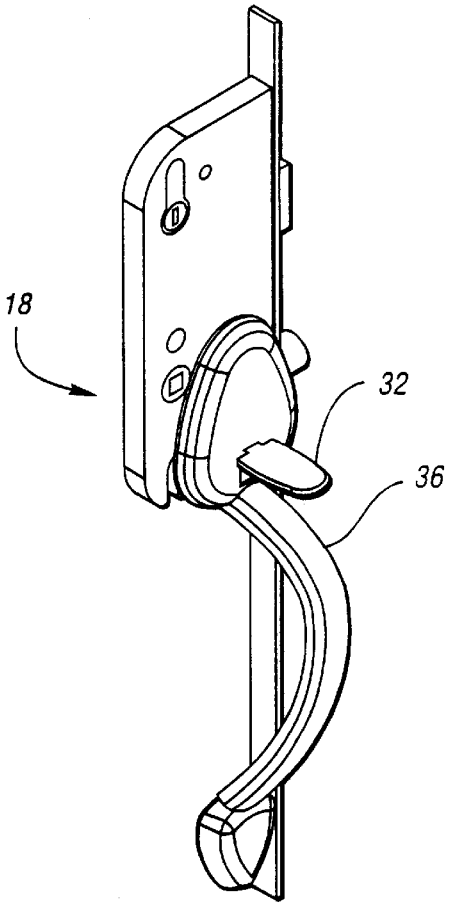
FIG. 2 is a perspective view of the central latch driving mechanism, a thumb-operated latch lever and a D-handle.
Figure 6:
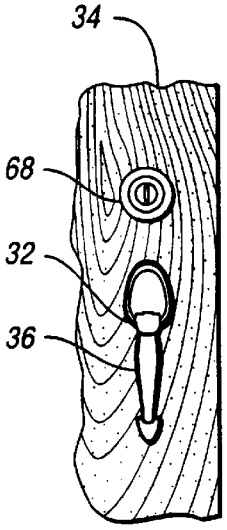
FIG. 6 is a fractional view of the exterior of the door and shows a representative cylinder lock and D-handle.

FIG. 2 shows the central latch driving mechanism 18 and a representative thumb-operated latch lever 32 and a D-handle 36. The D-handle 36 is attachable to a door, as shown in FIG. 6.

Figure 3:
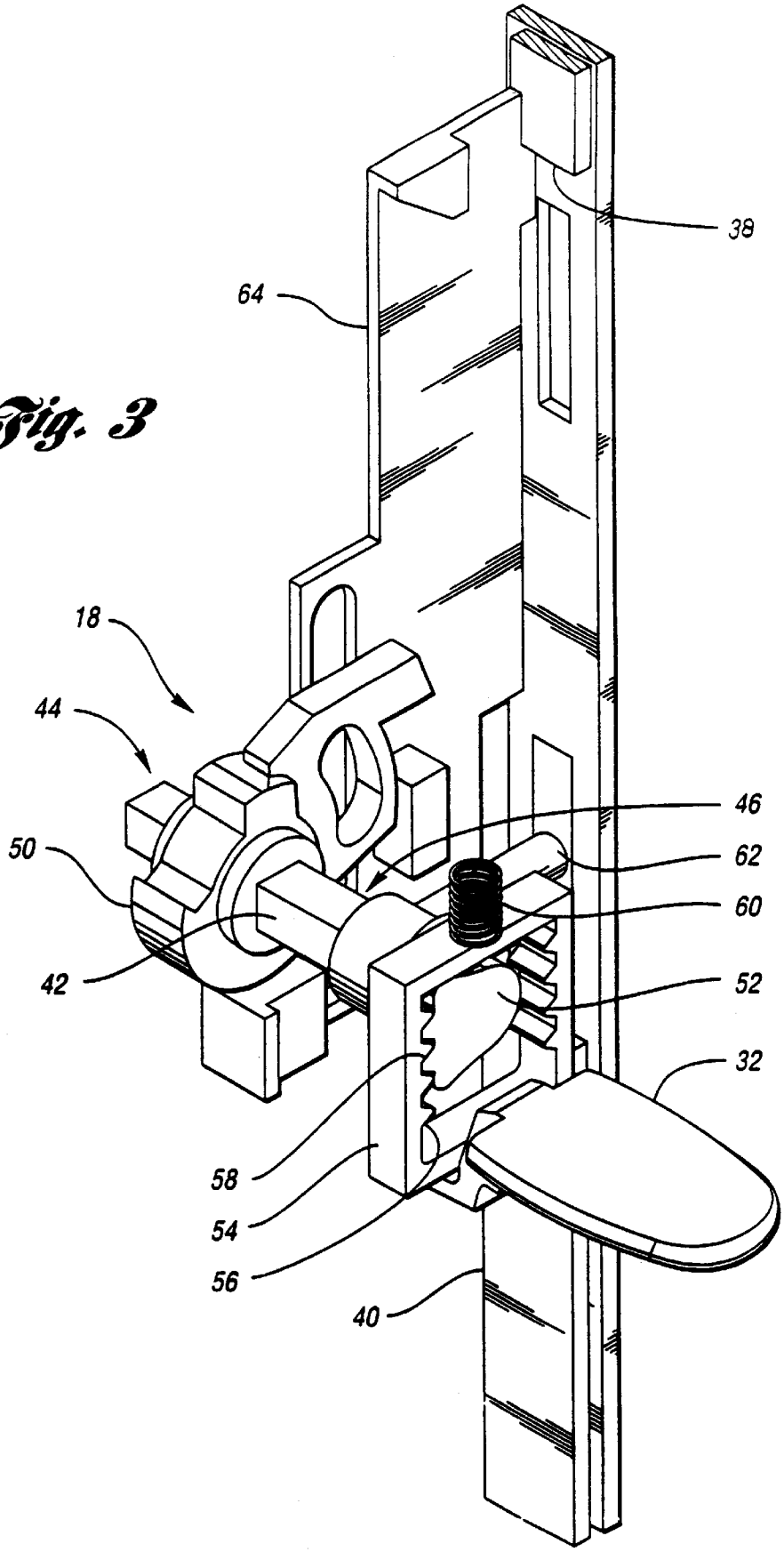
FIG. 3 is a perspective view of the central latch mechanism and a thumb-operated latch lever.

FIG. 3 is a perspective representation of the central latch driving mechanism 18 and the thumb-operated latch lever 32. The central latch driving mechanism 18 is shown without a cover to illustrate a mechanism used to convert the lever action of the thumb lever 32 into a linear movement of the central latch 20 and of upper and lower action bars 38 and 40. A spindle 42, having an interior end, generally indicated by the reference numeral 44 and an exterior end, generally indicated by the reference numeral 46, extends through the central latch driving mechanism 18. The interior end 44 protrudes through the door (FIG. 7) so that a doorknob 48 (FIGS. 7 and 9), or the like, can be mounted thereon.

The spindle 42 passes through an actuator 50, and its exterior end 46 is connected to a sector pinion 52. A double rack 54 is slidably disposed with its teeth 56 engaging the teeth 58 of the sector pinion 52. A downward movement of the thumb-operated latch lever 32 creates an upward movement of the rack 54. This upward movement is resiliently opposed by a rack spring 60. The upward movement of the rack 54 rotates the sector pinion 52 and the actuator 50. This retracts a central latch shaft 62 against the resilient force of the rack spring 60, which in turn retracts the central latch 20 to which it is attached.

A slidably disposed connector plate 64 extends vertically from the central latch driving mechanism 18. The slidably disposed upper action bar 38 extends from an upper end of the connector plate 64 to the upper remote latch driving mechanism 22 (FIG. 1). The connector plate 64 and the upper action bar 38 operably connect the central latch driving mechanism 18 to the upper remote latch driving mechanism 22 to communicate movement of the thumb-operated latch lever to the upper remote latch driving mechanism 22 and thus to the upper remote latch 24 (FIG. 1). Movement of the thumb-operated latch lever 32 is communicated by a lower action bar 40 to the lower remote latch driving mechanism 26 and thus to the lower remote latch 28 (FIG. 1). Each of the central and remote latches is resiliently biased toward an extended position.

The central latch driving mechanism 18, the central latch 20, the deadbolt 30, the upper and lower remote latches 24 and 28, the upper and lower latch driving mechanisms 22 and 26, the upper and lower action bars 38 and 40, and the mounting plate 14 cooperate to form the first subassembly 12. Being preassemblable, the first subassembly 12 facilitates time-, labor- and cost-effective manufacturing and installation.

FIG. 4 shows a fractional, perspective view of the upper free edge of the door 34 and includes a view of the upper remote latch 24. As seen in detail, the upper remote latch 24 includes a latch trigger 66. As shown, the upper remote latch 24 in an extended position, as it would appear after the door 34 had been opened and the thumb-operated latch lever 32 had been released. The upper remote latch 24 is in a position that allows the door 34 to be closed, the slanted portion of the upper remote latch 24 promoting its smooth retraction as it is wiped across a striker plate (not shown) as the door 34 is being closed. The foregoing description of FIG. 4 is also applicable to the lower remote latch 28.

FIG. 5 is similar to that of FIG. 4. The upper remote latch 24, however, is shown in a superextended position. This is the position it is allowed to assume after the door has been closed and the latch trigger 66 has been tripped by that action. While in the superextended position, the upper remote latch 24 is typically prevented from being forced to its retracted position unless the thumb-operated latch lever 32 is depressed. The foregoing description of FIG. 5 is also applicable to the lower remote latch 28.

FIG. 6 illustrates a central, exterior portion of the free edge of the door 34 and includes a view of the thumb-operated latch lever 32, of the D-handle 36 and of a key-operated lock, preferably a cylinder lock 68. The cylinder lock 68 controls the extension of the deadbolt 30 in response to the insertion and rotation of a key (not shown) therein. It will be appreciated by those skilled in the art that the cylinder lock 68 shown represents any of a number of well-known key-operated locks having a movable member capable of extending and retracting a deadbolt in response to a suitable motion of the key.

Figure 7:
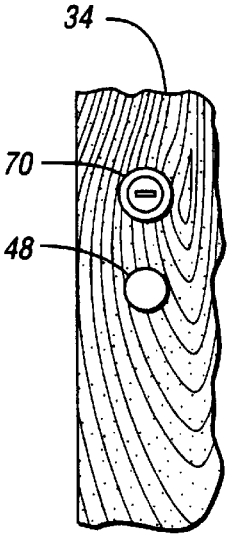
FIG. 7 is a fractional view of the interior of the door and shows a representative thumb-turn and door knob.

Shown in FIG. 7 is a view of the opposite side, that is, the interior side, of the portion of the free edge of the door 34 shown in FIG. 6. The view shows the doorknob 48, torque applied to rotate the doorknob 48 being applied thereby to the spindle 42. The view also shows a thumb-turn 70, which is a counterpart of the cylinder lock 68 in that it controls the extension of the deadbolt 30 in response to a rotation of the thumb-turn 70. While the deadbolt 30 is extended, either by rotating a key in the exterior-mounted cylinder lock 68 or by rotating the interior-mounted thumb-turn 70, neither the thumb-operated latch lever 32 nor the doorknob 48 is operable to retract the central latch 20, the upper remote latch 24 or the lower remote latch 28.

Figure 8:
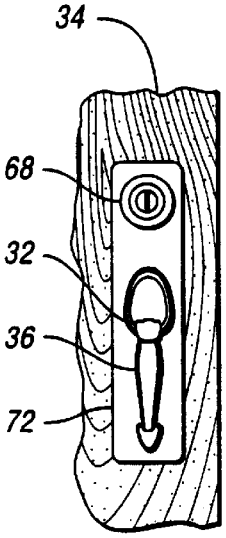
FIG. 8 is a view similar to that of FIG. 6 and further including an exterior trim plate.
Figure 9:
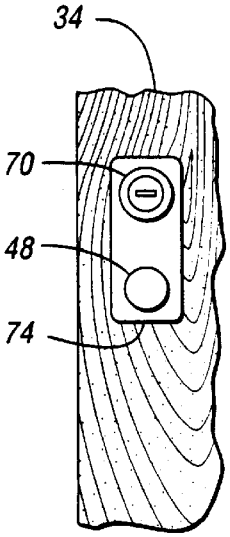
FIG. 9 is a view similar to that of FIG. 7 and further including an interior trim plate.

FIGS. 8 and 9 are similar to those of FIGS. 6 and 7 but further include views of exterior and interior trim plates 72 and 74 respectively. In FIG. 8, the exterior trim plate 72 is shown mounted between the D-handle 36 and the door 34 and with the cylinder lock 68 extending through. In FIG. 9, the interior trim plate 74 is shown mounted between the doorknob 48 and the door 34 and with the thumb-turn 70 extending through.

While embodiments of the invention have been illustrated and described, it is not intended that these embodiments illustrate and describe all possible forms of the invention. Rather, the words used in the specification are words of description rather than limitation, and that various changes may be made without departing from the spirit and scope of the invention.

What is claimed is:

1. A thumb-operated multilatch door lock attachable to a door, the thumb-operated multilatch door lock comprising:

an extendable and retractable central latch;

a central latch driving mechanism;

at least one extendable and retractable remote latch;

at least one remote latch driving mechanism, the at least one remote latch driving mechanism including at least one extendable and retractable action bar to communicate movements of the central latch driving mechanism to the at least one remote latch driving mechanism, the central latch driving mechanism having a rotatable spindle upon rotation of which in alternate directions the central latch driving mechanism retracts and extends the central latch and the at least one action bar of the at least one remote latch driving mechanism;

a movable thumb-operated latch lever adapted to be exposed on the door;

a handle adapted to be exposed on the exterior surface of the door and positioned to facilitate actuating the movable thumb-operated latch lever with a thumb while grasping, pushing and pulling the handle to open and close the door;

a rack responsive to the thumb-operated latch lever for movement in an upward direction when the thumb-operated latch lever is moved in a downward direction;

a rack spring resiliently biasing the rack in a downward direction; and a sector pinion connected to the spindle and engaging the rack for rotating the spindle, the rack when reciprocating in one direction rotating the spindle to extend the central latch and the at least one action bar, and the rack when reciprocating in another direction rotating the spindle to retract the central latch and the at least one action bar.

2. The thumb-operated multilatch door lock as defined by claim further including:

an elongate mounting plate upon which the central latch driving mechanism and the at least one remote latch driving mechanism are mounted, the mounting plate being mountable to a free edge of the door, the door having an exterior side and an interior side, the mounting plate having apertures through which the central latch and the at least one remote latch pass while they are extended.

3. The thumb-operated multilatch door lock as defined by claim 2, wherein:

the at least one remote latch includes an upper remote latch and a lower remote latch; and the at least one remote latch driving mechanism includes an upper remote latch driving mechanism and a lower remote latch driving mechanism, the upper and lower remote latches and the upper and lower remote latch driving mechanisms being respectively disposed above and below the central latch and the central latch driving mechanism.

4. The thumb-operated multilatch door lock as defined by claim 3, wherein the at least one action bar includes:

an upper action bar to communicate movements of the central latch driving mechanism to the upper remote latch driving mechanism; and a lower action bar to communicate movements of the central latch driving mechanism to the lower remote latch driving mechanism.

5. The thumb-operated multilatch door lock as defined by claim 4, further including:

a deadbolt slidable between a retracted position within the central latch driving mechanism and a position extending therefrom and through the mounting plate;

a key-operated lock adapted to be disposed within the door proximate the central latch driving mechanism, the key-operated lock having an exposed end adapted to receive a key, the exposed end being adapted to be exposed on the exterior side of the door, the key-operated lock effecting an extension and a retraction of the deadbolt when a key is inserted into the exposed end of the key-operated lock and rotated;

a thumb-turn adapted to be exposed on the interior side of the door and effecting an extension and retraction of the deadbolt when the thumb-turn is rotated; and a doorknob adapted to be exposed on the interior side of the door and adapted to be mounted on the spindle of the central latch driving mechanism to effect a retraction of the central and remote latches when the doorknob is rotated, neither the thumb-operated latch lever nor the doorknob being operable to retract the central or remote latches while the deadbolt is extended.

6. The thumb-operated multilatch door lock as defined by claim 5, wherein the central latch driving mechanism, the central latch, the deadbolt, the upper and lower remote latches, the upper and lower remote latch driving mechanisms, the upper and lower action bars, and the mounting plate cooperate to form a first subassembly.

7. The thumb-operated multilatch door lock as defined by claim 6, wherein each of the central and remote latches is resiliently biased toward its extended position by the rack spring.

8. The thumb-operated multilatch door lock as defined by claim 7, wherein the upper and lower remote latches each have a retracted, an extended and a superextended position, the upper and lower remote latches each further including a latch trigger, the latch triggers releasing the remote latches to extend to their superextended positions when the door is fully closed.

9. The thumb-operated multilatch door lock as defined by claim 1, wherein the rack is a double rack.

10. The thumb-operated multilatch door lock as defined by claim 1, wherein the handle is a D-handle.

11. A thumb-operated multilatch door lock attachable to a door, the thumb-operated multilatch door lock comprising:

an extendable and retractable central latch;

a central latch driving mechanism;

at least one extendable and retractable remote latch;

at least one remote latch driving mechanism, the at least one remote latch driving mechanism including at least one extendable and retractable action bar to communicate movements of the central latch driving mechanism to the at least one remote latch driving mechanism, the at least one remote latch having a retracted, an extended and a superextended position, the at least one remote latch further including a latch trigger, the at least one latch trigger releasing the at least one remote latch to extend to its superextended position when the door is fully closed;

the central latch driving mechanism having a rotatable spindle upon rotation of which in alternate directions the central latch driving mechanism retracts and extends the central latch and the at least one action bar of the at least one remote latch driving mechanism;

a movable thumb-operated latch lever adapted to be exposed on the door;

a handle adapted to be exposed on the door and positioned to facilitate actuating the movable thumb-operated latch lever with a thumb while grasping, pushing and pulling the handle to open and close the door;

a rack responsive to the thumb-operated latch lever for movement in an upward direction when the thumb-operated latch lever is moved in a downward direction;

a rack spring resiliently biasing the rack in a downward direction;

a sector pinion connected to the spindle and engaging the rack for rotating the spindle, the rack when reciprocating in one direction rotating the spindle to extend the central latch and the at least one action bar, and the rack when reciprocating in another direction rotating the spindle to retract the central latch and the at least one action bar;

an elongate mounting plate upon which the central latch driving mechanism and the at least one remote latch driving mechanism are mounted, the mounting plate being mountable to a free edge of the door, the door having an exterior side and an interior side, the mounting plate having apertures through which the central latch and the at least one remote latch pass while they are extended;

a deadbolt slidable between a retracted position within the central latch driving mechanism and a position extending therefrom and through the mounting plate;

a key-operated lock adapted to be disposed within the door proximate the central latch driving mechanism, the key-operated lock having an exposed end adapted to receive a key, the exposed end being adapted to be exposed on the exterior side of the door, the key-operated lock effecting an extension and a retraction of the deadbolt when a key is inserted into the exposed end of the key-operated lock and rotated;

a thumb-turn adapted to be exposed on the interior side of the door and effecting an extension and retraction of the deadbolt when the thumb-turn is rotated; and a doorknob adapted to be exposed on the interior side of the door and adapted to be mounted on the spindle of the central latch driving mechanism to effect a retraction of the central latch and the at least one remote latch when the doorknob is rotated, and the central latch driving mechanism, the central latch, the deadbolt, the least one remote latch, the at least one remote latch driving mechanism, the at least one action bar, and the mounting plate cooperating to form a first subassembly.

12. The thumb-operated multilatch door lock as defined by claim 11, wherein the rack is a double rack.

13. The thumb-operated multilatch door lock as defined by claim 11, wherein the handle is a D-handle.

14. The thumb-operated multilatch door lock as defined by claim 11, wherein neither the thumb-operated latch lever nor the doorknob is operable to retract the central latch or the at least one remote latch while the deadbolt is extended.

* * * * *